US009165730B2

(12) United States Patent
Bunk et al.

(10) Patent No.: US 9,165,730 B2
(45) Date of Patent: Oct. 20, 2015

(54) SWITCHING APPARATUS

(71) Applicants: Thomas Bunk, Sulzbach-Rosenberg (DE); Siegfried Pirker, Ensdorf (DE)

(72) Inventors: Thomas Bunk, Sulzbach-Rosenberg (DE); Siegfried Pirker, Ensdorf (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 162 days.

(21) Appl. No.: 13/739,168

(22) Filed: Jan. 11, 2013

(65) Prior Publication Data

US 2013/0206560 A1 Aug. 15, 2013

(30) Foreign Application Priority Data

Feb. 13, 2012 (DE) ..... 10 2012 202 085

(51) Int. Cl.
*H01H 21/22* (2006.01)
*H01H 71/52* (2006.01)

(52) U.S. Cl.
CPC ..... *H01H 21/22* (2013.01); *H01H 71/521* (2013.01); *H01H 71/522* (2013.01)

(58) Field of Classification Search
CPC .. H01H 71/525; H01H 71/501; H01H 23/143
USPC ..... 200/339, 401; 335/166, 172, 171
See application file for complete search history.

(56) References Cited

U.S. PATENT DOCUMENTS

| | | | | |
|---|---|---|---|---|
| 4,129,762 | A | 12/1978 | Bruchet | |
| 4,546,224 | A | 10/1985 | Mostosi | |
| 5,369,384 | A | 11/1994 | Heins | |
| 5,500,496 | A * | 3/1996 | Venzke et al. | 200/339 |
| 6,084,191 | A | 7/2000 | Kataya et al. | |

FOREIGN PATENT DOCUMENTS

| | | |
|---|---|---|
| DE | 4227213 A1 | 2/1994 |
| EP | 0555158 A1 | 8/1993 |

OTHER PUBLICATIONS

German Priority Document German Application 10 2012 202 085.3.
German Office Action for German Application 10 2012 202 085.3 Dated Dec. 17, 2012.

* cited by examiner

*Primary Examiner* — Renee Luebke
*Assistant Examiner* — Ahmed Saeed
(74) *Attorney, Agent, or Firm* — Harness, Dickey & Pierce, P.L.C.

(57) ABSTRACT

A switching apparatus for an electric switch, in particular an electric circuit breaker, including a switching head with a grip section, and a switching frame connected to the switching head. In an embodiment, a bearing end of at least one spring element is mounted on the switching frame on at least one bearing device. The switching head for the bearing end of at least one spring element includes at least one positioning depression on the side of the switching head opposite to the grip section, which is embodied for a lateral positioning of the bearing end.

11 Claims, 3 Drawing Sheets

SWITCHING APPARATUS

PRIORITY STATEMENT

The present application hereby claims priority under 35 U.S.C. §119 to German patent application number DE 10 2012 202 085.3 filed Feb. 13, 2012, the entire contents of which are hereby incorporated herein by reference.

FIELD

At least one embodiment of the present invention generally relates to a switching apparatus for an electric switch, in particular an electric circuit breaker.

BACKGROUND

Switching apparatuses for an electric switch are known. They frequently comprise one or more spring elements in order to make forces available for individual switching processes within such a switching apparatus. Such spring elements are frequently embodied as coil springs, which comprise bearing ends on one or on both sides and are suited to storing and releasing force in such a switching apparatus. These bearing ends may be spring eyelets for instance.

In order to mount the spring elements on corresponding mechanical components of the switching apparatuses, bearing devices are frequently provided. In known switching apparatuses, these bearing devices are for instance fastened in a switching frame so that force can be transmitted between this switching frame and the spring element. Similarly switching heads are likewise frequently provided on such a switching frame, which can be moved by way of a grip section between different positions, in particular an on position and an off position.

In known switching apparatuses, the spring element is positioned in respect of the switching frame by corresponding geometrical embodiments on the switching frame. Fixing pins or notches are therefore provided in the material on the switching frame, which generate a positioning or an additional fixing of the spring element on the switching frame. The use of additional fixing pins increases the complexity and thus also the costs of such a switching apparatus. If a notch is provided on the switching frame for the positioning, a mechanical weakening of the switching frame thus occurs in this way so that the frame has to be additionally reinforced at other points.

The positioning of the spring element is required in order to be able to predetermine the desired force ratios inside such a switching apparatus in a precise and predefined manner. Furthermore, it is disadvantageous in known switching apparatuses for the spring length of such a spring element to be restricted. The dimensions of the overall switching apparatuses must be enlarged in known switching apparatuses if the spring element requires a longer effective spring length.

SUMMARY

At least one embodiment of the present invention at least partly eliminates at least one of the previously described disadvantages of known switching apparatuses for electric switches, in particular circuit breakers. At least one embodiment of the present invention provides a switching apparatus for an electric switch, in particular circuit breaker, which includes a lengthened effective spring length, in a cost-effective and simple manner, while simultaneously retaining the mechanical stability of the switching apparatus.

Further features and details of the invention result from the subclaims, the description and the drawings. Here the features and details which are described in conjunction with the inventive switching apparatus naturally also apply in conjunction with the inventive subclaims and vice versa in each instance, so that with respect to the disclosure relating to the individual invention aspects, reference is or can alternately always be made.

An embodiment of an inventive switching apparatus for an electric switch, in particular an electric circuit breaker, such as a compact circuit breaker, comprises a switching head. This switching head is equipped with a grip section, which is used to move the switching head. A switching frame is also provided, which is connected to the switching head, in other words can be moved together with the switching head. A bearing end of at least one spring element is mounted on the switching frame using at least one bearing device. Such a bearing device may be for instance a pin or a bearing shaft, which rests against the switching frame. An integral embodiment of the bearing device with the switching frame and/or the switching head is conceivable within the scope of the present invention.

An embodiment of an inventive switching apparatus is characterized in that the switching head for the bearing end of the at least one spring element has at least one positioning depression. This is arranged on the opposite side of the switching head in respect of the grip section. This positioning depression is further embodied for a lateral positioning of the bearing end. Within the scope of the invention the term lateral positioning is understood to be a positioning, in particular at right angles to the spring direction of the at least one spring element. If the spring element is embodied in the form of a coil spring for instance, this can preferably comprise a spring eyelet as a bearing end. This spring eyelet can be mounted on a bearing device embodied as a shaft. Here, within the scope of the embodiment of the present invention, the bearing device can be embodied without positioning aids so that a free movement of the spring element, in particular of the bearing end, can basically take place on the bearing devices. Notches weakening the bearing device mechanically are avoided in this way.

BRIEF DESCRIPTION OF THE DRAWINGS

The invention above is described in more detail with the aid of the appended figures of the drawing. The terms "right" and "top" used here relate to an alignment of the drawings with reference characters which can be read normally, in which, shown schematically.

Elements with the same function and mode of operation are provided with the same reference characters in FIGS. 1 to 5 respectively.

DETAILED DESCRIPTION OF THE EXAMPLE EMBODIMENTS

Figure 1:
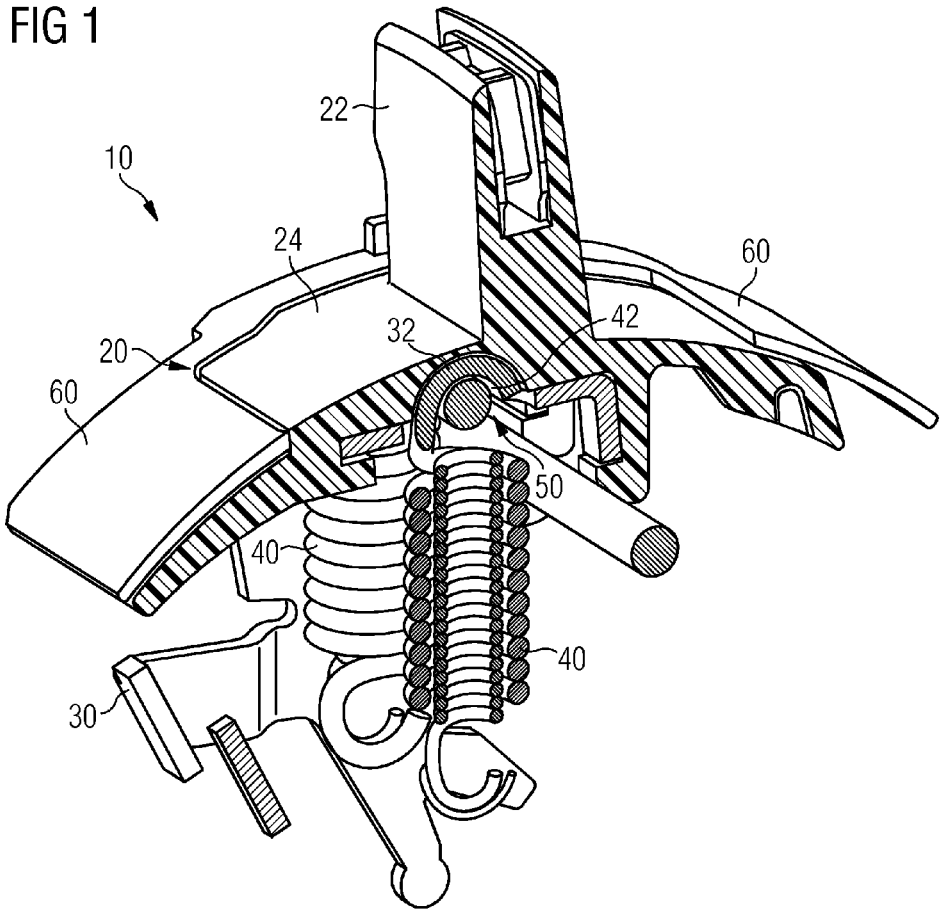
FIG. 1 shows a first embodiment of an inventive switching apparatus.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

An embodiment of an inventive switching apparatus for an electric switch, in particular an electric circuit breaker, such as a compact circuit breaker, comprises a switching head. This switching head is equipped with a grip section, which is used to move the switching head. A switching frame is also provided, which is connected to the switching head, in other words can be moved together with the switching head. A bearing end of at least one spring element is mounted on the switching frame using at least one bearing device. Such a bearing device may be for instance a pin or a bearing shaft, which rests against the switching frame. An integral embodiment of the bearing device with the switching frame and/or the switching head is conceivable within the scope of the present invention.

An embodiment of an inventive switching apparatus is characterized in that the switching head for the bearing end of the at least one spring element has at least one positioning depression. This is arranged on the opposite side of the switching head in respect of the grip section. This positioning depression is further embodied for a lateral positioning of the bearing end. Within the scope of the invention the term lateral positioning is understood to be a positioning, in particular at right angles to the spring direction of the at least one spring element. If the spring element is embodied in the form of a coil spring for instance, this can preferably comprise a spring eyelet as a bearing end. This spring eyelet can be mounted on a bearing device embodied as a shaft. Here, within the scope of the embodiment of the present invention, the bearing device can be embodied without positioning aids so that a free movement of the spring element, in particular of the bearing end, can basically take place on the bearing device. Notches weakening the bearing device mechanically are avoided in this way.

The positioning takes place by connecting the switching head to the switching frame, for instance by attaching and locking the switching head on the switching frame. A positioning of the bearing end and therefore a positioning of the spring element is thus achieved by engaging the bearing end in the positioning depression. In other words, the spring element extends with its bearing end at least partly into the switching head, namely into its positioning depression. The maximum possible length of a spring element in a switching apparatus is lengthened by the positioning depression without the overall geometrical dimensions of the switching apparatus having to be changed. Aside from the mechanical stability, an increased effective spring length is also achieved without additional parts.

An inventive switching apparatus of at least one embodiment can be embodied to be moveable. This means that the switching apparatus, in other words the switching head together with the switching frame, can be mounted moveably between two or more positions. In order to generate the desired spring forces across the spring element or to be able to store them therein, a second, preferably oppositely mounted bearing end of the spring element can be mounted on other components of an electric switch, so that the length of the spring element and thus the correspondingly stored spring force of the spring element changes depending on the position of the switching apparatus or the position of the switching head.

It is possible to dispense with mechanical or structural changes to the switching frame by using a positioning depression. Instead, the switching frame responsible for mechanical stability can be configured in respect of mechanical requirements. The positioning takes place by way of mechanical components which are not additionally loaded such as the switching head, in particular the grip section. The switching head can for instance be embodied from plastic, since the force involved in positioning is smaller by a multiple than the spring force exerted on the bearing device by the spring element. A particularly simple assembly of the spring element on the bearing device is therefore possible. A positioning separate from the bearings is therefore possible. The bearing can be generated by the spring element with its mounting element being easily mounted in a first step at or on the bearing device.

Upon assembly of the switching head with the switching frame, in particular as a second step, the positioning of the spring element is achieved by the bearing end of the at least one spring element engaging in the positioning depression. The positioning depression is preferably embodied at least in one, in particular in two directions, with its geometrical dimensions correlating with the geometrical dimensions of the bearing end. The bearing end is preferably slid into the positioning depression so that the positioning of the bearing end can take place automatically. Alternatively, chamfers or other guide contours are conceivable for such a function. With this movement the bearing end can be guided in particular through the walls of the positioning depression.

A further advantage of an inventive switching apparatus is that, on account of the positioning of the bearing ends of the spring element by the positioning depressions, the recess necessary for the spring element can be configured such that assembly can take place from above. The costs and outlay involved in assembly are thus reduced again.

It may be advantageous if, with an embodiment of an inventive switching apparatus, the positioning depression comprises a width and/or length which correspond to the corresponding dimension of the bearing end of the spring element. Correspondence of the respective geometric dimensions is understood to mean that the width and/or length of the bearing end or the positioning depression comprise only minimal geometric dimensional differences (minimal play) which correspond to one another.

The positioning depression is preferably embodied in respect of the correspondence of the dimensions as a clearance fit, so that simple insertion of the bearing end into the positioning depression can take place. The width is understood to mean for instance the width of a bearing end embodied as a spring eyelet with respect to the diameter of the spring wire. The length is preferably the extension transverse to, in particular at right angles to this width. Such an embodiment preferably reduces the number or size of frictional surfaces between the positioning depression and the bearing end. The friction during the relative movement or during a possible relative movement between the bearing end and the inner walls of the positioning depression is thus reduced so that wear or loss of power is similarly reduced in order to overcome such a frictional force.

It is similarly advantageous if with an embodiment of an inventive switching apparatus, the at least one bearing device has a shaft section, on which the bearing end of the spring element is mounted. A bearing section is further preferably provided, by way of which the bearing device is mounted rotatably in the switching frame. This embodiment involves a separate component in respect of the bearing device. This separate component can preferably be used multiple times in an embodiment of an inventive switching apparatus so that the complexity of an inventive switching apparatus can be further reduced. Furthermore, the use of a separate component enables the assembly of the spring element, in particular the generation of the bearing of the bearing end on the bearing section of the bearing device to be implemented in a particularly cost-effective and rapid fashion.

In this embodiment, a relative movement preferably occurs exclusively between the bearing device and the switching frame. In other words, a relative movement between the bearing end of the spring element and the bearing device is prevented completely or essentially completely. Friction between the shaft section of the bearing device and the bearing end of the spring element can therefore be reduced or prevented so that the relative movement takes place in a defined and above all low frictional manner relatively between the bearing device and the switching frame, in particular between the bearing section and the switching frame. This can be achieved for instance in that the diameter of the shaft section is larger than the diameter of the bearing section. On account of the reduced frictional radius, this results in the relative rotation essentially taking place exclusively between the bearing section of the bearing device and the switching frame.

It may likewise be advantageous if, in an embodiment of an inventive switching apparatus, the positioning depression has a depth which is greater than corresponding height of the bearing end of the spring element. Depth or height of the respective component is understood to mean an extension which, in both instances, in the assembled state of the switching apparatus, essentially points in the same direction, in particular in the insertion direction into the positioning depression. In other words, the height of engagement of the bearing end in the positioning depression is smaller than the depth of this positioning depression in the engagement direction of the bearing end of the spring element. A contact of the components in this direction, in other words in particular on the base surface of the positioning depression, is therefore prevented. A further frictional surface is prevented in this way so that frictional force and wear can be reduced. In other words, aside from the lateral positioning, a gap or a play can be made available in the insertion direction, which exists between the base surface of the positioning depression and the bearing end of the spring element.

A further advantage is if, with an embodiment of an inventive switching apparatus, the positioning depression comprises an outer contour. This outer contour comprises at least one first contour section, which corresponds to the geometric dimension of a first form of a bearing end of a spring element. Further, this outer contour comprises a second contour section, which corresponds to the geometric dimension of a second form of a bearing end of a spring element. Here the two different forms of the bearing end of a spring element are preferably available in different spring elements.

The correspondence inventively means that the outer contour has different contour sections, each of which is embodied to correspond to a different spring element, in particular its different bearing ends. This means that one and the same positioning depression can be used for different embodiments for spring elements. The contour sections, which correspond to the respective bearing end of the respective other embodied spring element, can also be embodied as positioning contours. They act as positioning for different spring elements, so that with a switching apparatus embodied as such, the same positioning depression can be used for the positioning of differently embodied bearing ends of different spring elements. The individual contour sections can extend or preferably even overlap here. Parts of the contour sections can therefore correspond to dimensions of two or more spring elements, so that a sufficiently stable and precise positioning can even be achieved for different spring elements with the aid of such a positioning depression.

It is similarly advantageous if, with an embodiment of an inventive switching apparatus, the switching head has a raised area on the side of the grip section. The at least one positioning depression is arranged below this raised area. The raised area is used such that additional material is made available on the switching head in particular as a rucksack concept. This raised area allows the positioning depression to be pushed further into the material of the switching head, in other words can be embodied deeper so that the effective spring length is increased. This increase is in particular flush with a surrounding cover, for instance surrounding cover plates, if a large switch engagement opening has to be covered for the switching apparatus. The effective spring length of the spring element can thus be enlarged in the desired manner.

A further advantage is if, in an embodiment of an inventive switching apparatus, the positioning depression is arranged essentially opposite to the grip section of the switching head. The positioning depression is therefore preferably within the grip section. The grip section is embodied for instance with an increased material strength, so that the positioning depression can extend entirely into a part of the grip section which is embodied to be hollow in parts for instance. The effective spring length of the spring element is therefore further increased without the complexity of the switching apparatus, in particular of the switching head, having to be increased. Here the positioning depression can be arranged in particular precisely opposite the grip section and accordingly inside this grip section.

It is likewise advantageous if, with an embodiment of an inventive switching apparatus, the positioning depression extends inside the grip section. As already described above, this is particularly advantageous since the effective spring length of the spring element can therefore be maximized.

FIG. 1 shows a first embodiment of an inventive switching apparatus 10. It is equipped with two basic components, namely a switching head 20 and a switching frame 30. FIG. 1 shows the assembled state, in other words a state in which the switching head 20 is attached to the switching frame 30, in particular locked thereto.

The switching head 20 of the embodiment according to FIG. 1 is provided with a grip section 22. The grip section 22 can be manually gripped by way of grip surfaces, so that a movement of the grip section 22 and thus of the switching head 20 and in this way the entire switching apparatus 10 can take place. The movement by way of the grip section 22 is preferably a rotation of the entire switching apparatus 10.

Figure 2:
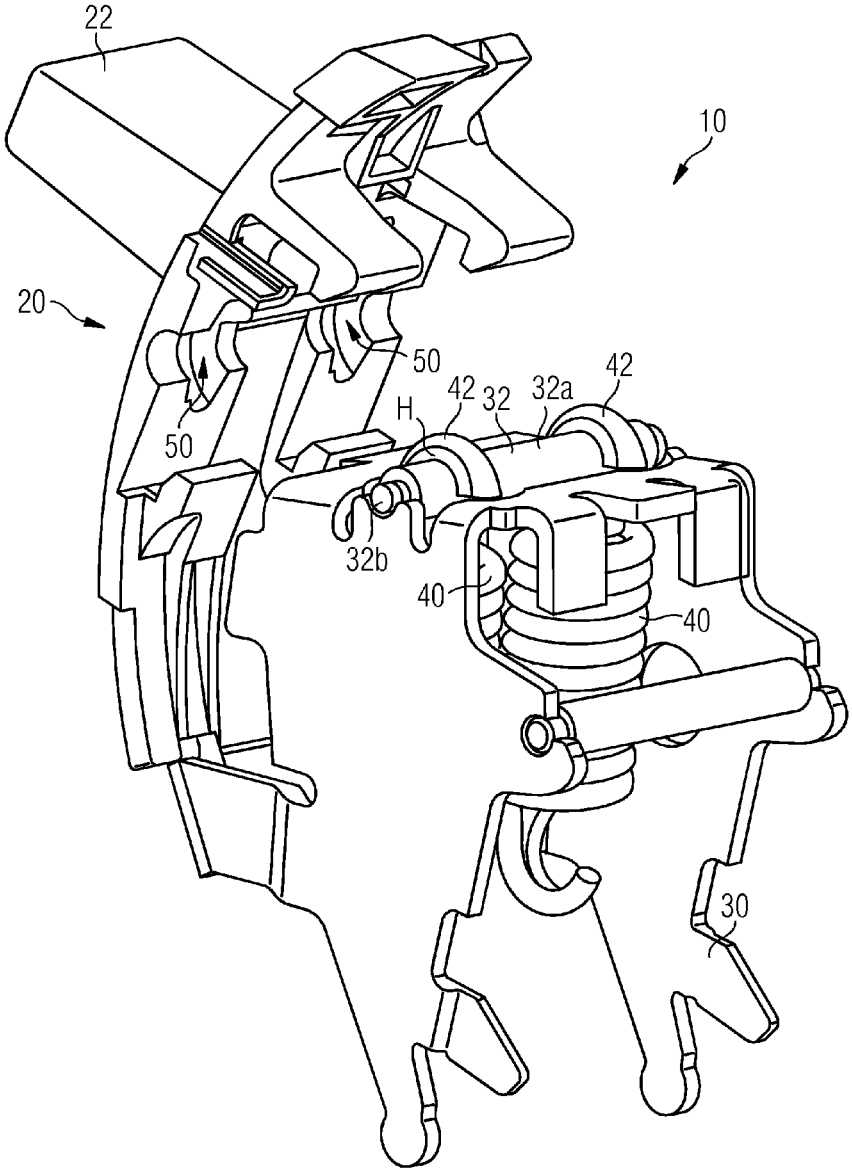
FIG. 2 shows the embodiment in FIG. 1 in a partly disassembled state.

The switching apparatus 10 is furthermore provided with a spring element 40. In this embodiment two spring elements 40 are provided in the form of a coil spring. Each of these two spring elements 40 is equipped with a bearing end 42. The bearing end 42 is the upper end of the spring element 40 and is embodied as a spring eyelet in the form of the spring element 40. FIG. 2 shows how force is transmitted between the spring element 40 via the respective bearing end 42 to the switching frame 30. FIG. 2 therefore shows that a bearing device 32 is provided in the form of a bearing shaft. The bearing device 32 comprises a shaft section 32*a* and a bearing section 32*b*. The spring eyelets of the bearing device 32 are mounted on the shaft section 32*a*. The force is further transmitted via the support surfaces on the bearing sections 32*b*. The diameter of the bearing sections 32*b* is smaller than the diameter of the shaft section 32*a*, so that with the overall movement of the switching apparatus 10, a relative movement is effected between the bearing device 23 and the switching frame 30 on the contact surfaces of the bearing section 32*b*.

The opposite fastening of the spring elements 40 is not shown. Eyelets are likewise provided on the lower end of the spring elements 40, which can be fastened to a switching mechanism or to contact levers of an electric switch. The current spring length of the spring elements 40 can be changed on this switching mechanism by moving the switching apparatus 10, so that the force situation of the stored force can be varied in the spring elements 40.

The effective spring length of the spring element 40 is lengthened by the inventive embodiment of the switching apparatus 10. FIG. 2 effectively shows that two positioning depressions 50 are provided on the side of the switching head 20 facing the grip section 22. Both positioning depressions 50 are embodied with the predefined and desired position of the respective spring element 40, in particular of the respective bearing end 42. FIG. 1 shows the locked position, in which two lugs, which are visible in the switching head 20 to the top right in FIG. 2, are locked with the switching frame 30. When locking the switching head 20 on the switching frame 30, the bearing ends 42 of the spring elements 40 are inserted at the same time into the respectively assigned positioning depression 50.

Figure 4:
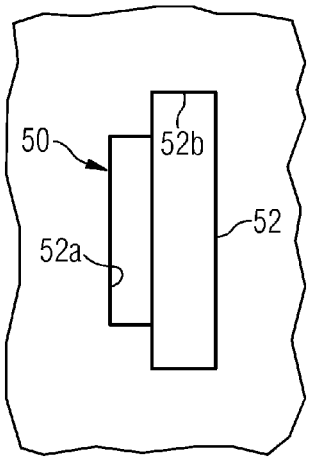
FIG. 4 shows an embodiment of a positioning depression.
Figure 5:
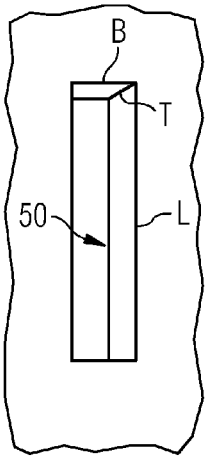
FIG. 5 shows a further embodiment of a positioning depression.

The two positioning depressions 50 are embodied for instance such as are shown in FIG. 4 and FIG. 5. The positioning depressions 50 comprise a width B, a depth T and a length L. In particular, the width B correlates here with the width of the spring element 40, in particular of the bearing ends 42 of these spring elements 40. Therefore, upon insertion of the respective bearing end 42 into the positioning depression 50, a positioning in the direction of this width B, in other words transverse to the direction of spring action of the respective spring element 40, is achieved.

The depth T is preferably greater than the corresponding height of the bearing end 42, so that a gap remains between the base surface of the positioning depression 50 and the bearing end 42.

As shown in FIGS. 1 and 2, no additional positioning is provided on the bearing device 32 of the switching frame 30. An adequate mechanical stability can be provided there despite a simple wave-type embodiment of a bearing device 32. In particular, no notches are required to define the position of the bearing ends of the spring elements.

FIG. 1 also shows for instance that a raised area 24 can be provided, below which the positioning depression 50 extends. The effective spring length for the spring elements 40 can be further increased without changing the geometric extension of the entire switching apparatus 10.

Figure 3:
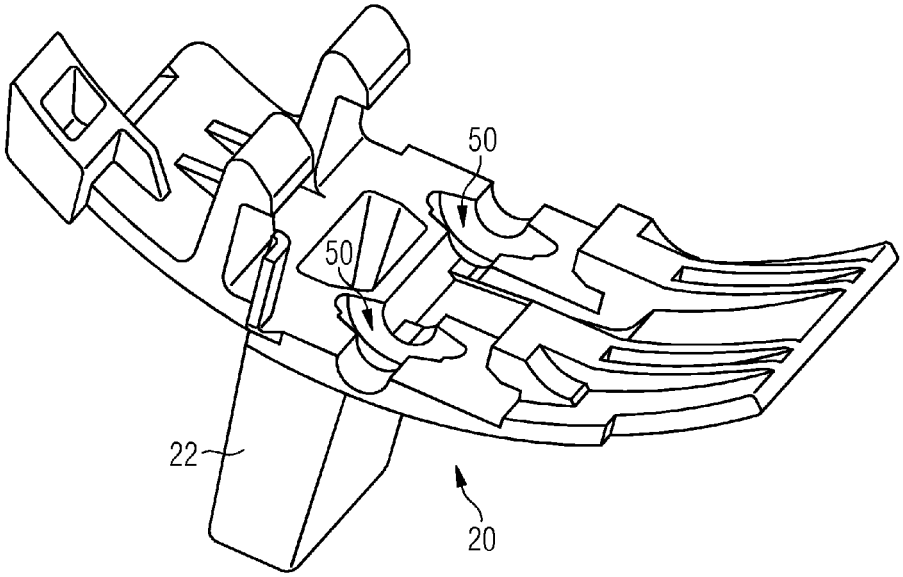
FIG. 3 shows the switching head of the embodiment according to FIG. 1.

FIG. 3 or FIG. 4 shows in greater detail that a switching head 20 can also be embodied for differently shaped bearing ends 32 of different spring elements 40. Such a positioning depression 50 is therefore embodied for instance with an outer contour 52, which can be split into several contour sections, in particular a first contour section 52*a* and a second contour section 52*b*. The two contour sections 52*a* and 52*b* correspond to different sizes of bearing ends 42 of different spring elements 40. The first contour section 52*a* can be provided with a shorter length L than is the case with the second contour section 52*b* of the outer contour 52. Positioning of different bearing ends 52, in particular with different lengths and/or eyelet diameters of the bearing ends 42, can be implemented with one and the same positioning depression 50.

The preceding explanations of the embodiments only describe the present invention within the scope of examples. Individual features of the embodiments, insofar as technically meaningful, can naturally be freely combined with one another without departing from the scope of the present invention. Within the scope of the invention, electric switches are in particular electric circuit breakers, such as for instance compact circuit breakers.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

10 Switching apparatus
20 Switching head
22 Grip section
24 Raised area
30 Switching frame
32 Bearing device
32*a* Shaft section
32*b* Bearing section
40 Spring element
42 Bearing end
50 Positioning depression
52 Outer contour
52*a* First contour section
52*b* Second contour section
60 Cover
B Width of the positioning depression
L Length of the positioning depression
T Depth of the positioning depression
H Height of the bearing end

What is claimed is:

1. A switching apparatus for an electric switch, comprising:

a switching head including a grip section on a first surface and at least one lug protruding from a second surface; and a switching frame, interlocked with the switching head via the at least one lug, wherein a bearing end of at least one spring element is mounted on the switching frame on at least one bearing device, wherein the switching head including at least one positioning depression in a side of the switching head opposite to the grip section that receives the bearing end of the at least one spring element therein for a lateral positioning of the bearing end, wherein the at least one spring element includes a first and second spring element, and wherein the at least one positioning depression includes an exterior contour, including at least one first contour section which corresponds to a geometric dimension of a first form of a bearing end of the first spring element, and at least one second contour section different from the at least one first contour section, corresponding to a geometric dimension of the second form of a bearing end of the second spring element.

2. The switching apparatus of claim 1, wherein the at least one positioning depression includes at least one of a width and a length, corresponding to a corresponding dimension of the bearing end of the at least one spring element.

3. The switching apparatus of claim 1, wherein the at least one bearing device comprises a shaft section, on which the bearing end of the at least one spring element is mounted, and a bearing section, by way of which the at least one bearing device is rotatably mounted in the switching frame.

4. The switching apparatus of claim 1, wherein the at least one positioning depression includes a depth greater than a corresponding height of the bearing end of the at least one spring element.

5. A switching apparatus of claim 1, wherein the switching head includes a raised area on the side of the grip section, under which the at least one positioning depression is arranged.

6. The switching apparatus of claim 1, wherein the bearing end of the at least one spring element is embodied as a spring eyelet arranged on a shaft as a bearing device.

7. The switching apparatus of claim 1, wherein the at least one positioning depression is essentially arranged precisely opposite to the grip section of the switching head.

8. The switching apparatus of claim 7, wherein the at least one positioning depression extends into an inside of the grip section.

9. The switching apparatus of claim 1, wherein the switching apparatus is for an electric circuit breaker.

10. The switching apparatus of claim 2, wherein the at least one bearing device comprises a shaft section, on which the bearing end of the at least one spring element is mounted, and a bearing section, by way of which the at least one bearing device is rotatably mounted in the switching frame.

11. The switching apparatus of claim 2, wherein the at least one positioning depression includes a depth greater than a corresponding height of the bearing end of the at least one spring element.

* * * * *